US006701882B2

(12) United States Patent
Barbezat

(10) Patent No.: US 6,701,882 B2
(45) Date of Patent: Mar. 9, 2004

(54) SURFACE LAYER FOR THE WORKING SURFACE OF THE CYLINDERS OF A COMBUSTION ENGINE AND PROCESS OF APPLYING THE SURFACE LAYER

(75) Inventor: Gérard Barbezat, Opfikon (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 10/366,875

(22) Filed: Feb. 14, 2003

(65) Prior Publication Data

US 2003/0164150 A1 Sep. 4, 2003

(30) Foreign Application Priority Data

Feb. 27, 2002 (CH) ..... 0346/02

(51) Int. Cl.[7] ..... C23C 4/10
(52) U.S. Cl. ..... 123/193.2; 427/446
(58) Field of Search ..... 123/193.2; 427/446–456

(56) References Cited

U.S. PATENT DOCUMENTS

| | | | | |
|---|---|---|---|---|
| 4,885,213 A | * | 12/1989 | Miyamoto et al. | 428/612 |
| 5,151,308 A | | 9/1992 | Moskowitz et al. | |
| 5,766,693 A | | 6/1998 | Rao | |
| 6,159,554 A | * | 12/2000 | Kloft et al. | 427/456 |
| 6,280,796 B1 | * | 8/2001 | Kloft et al. | 427/456 |
| 2002/0011243 A1 | | 1/2002 | Barbezat | |

FOREIGN PATENT DOCUMENTS

| | | |
|---|---|---|
| DE | 197 11 756 A1 | 9/1998 |
| EP | 0 715 916 | 6/1996 |
| EP | 0 716 158 A1 | 6/1996 |
| EP | 1 022 351 A1 | 7/2000 |
| WO | WO 99/05339 | 2/1999 |

OTHER PUBLICATIONS

Barbezat G. et al., Plasmabeschichtungen von Zylinderkurbelgehäusen und ihre Bearbeitung durch Honen, MTZ Motortechnische Zeitschrift, Franckh'Sche Verlagshandlung, Abteilung Technik. Stuttgart, DE. Bd. 62, Nr. 4, Apr. 1, 2001, Seiten 314–320, ISSN: 0024–8525, XP–001017720.

Database WPI, Section Ch, Week 197927, Derwent Publications Ltd., London, GB; AN 1979–50021B & JP 54 066341 A (Riken Light Metal Ind Co), May 28, 1979, Zusammenfassung, XP–002210655.

* cited by examiner

*Primary Examiner*—Marguerite McMahon
(74) *Attorney, Agent, or Firm*—Maginot, Moore & Beck

(57) ABSTRACT

A surface coating of the working surface of a cylinder of a combustion engine is disclosed, having the combination of the following characteristics:

The coating is applied by plasma spraying; the surface of the coating comprises a plurality of open pores; the degree of porosity of the surface of the coating amounst to between 0.5 and 10%; the statistic mean pore size amounts to between 1 and 50 $\mu$m, whereby at least nearly exclusively pores with a size of less than 100 $\mu$m are present; the pores are stochastically distributed in the surface of the coating, both as far as the area and the size is concerned; the coating comprises a content of bound oxygen of between 0.5 and 8% by weight; the coating comprises inclusions of FeO and $Fe_3O_4$ crystals, serving as solid lubricants; and the roughness of the surface of the coating is adjusted by mechanically finishing to an arithmetic mean roughness $R_a$ of between 0.02 and 0.4 $\mu$m and to a mean peak-to-valley distance $R_z$ of between 0.5 and 5 $\mu$m. The pores form a plurality of micro chambers, supporting the build-up of an oil film between piston rings and cylinder wall.

21 Claims, 2 Drawing Sheets

SURFACE LAYER FOR THE WORKING SURFACE OF THE CYLINDERS OF A COMBUSTION ENGINE AND PROCESS OF APPLYING THE SURFACE LAYER

BACKGROUND OF THE INVENTION

The present invention refers to a surface coating of the working surface of a cylinder of a combustion engine as well as to a method of applying a surface coating to the working surface of a cylinder of a combustion engine.

Distinctive progress having been made in recent times in developing new motor oils having an extended useful life, it would be desirable to reduce the oil consumption of combustion engines to such a degree that the oil change intervals could be further extended. The objectives could be seen, for example, to change the oil only once in a 60,000 miles period without the need to top-up the oil level in the engine.

It is well known that the nature of the surface, i.e. the topography of the cylinder wall, has a crucial influence on the oil consumption. Even if a high surface finish can be achieved e.g. by honing, today's cylinder working surfaces usually have a not closer specified porosity and are provided at least with a number of pores, respectively, which are comparatively large, thus negatively influencing the oil consumption.

PRIOR ART

The patent publication WO 99/05339 A1 discloses a thermal plasma coating process for interior walls, particularly for sleeve bearings, having as an object to avoid, whenever possible, the formation of oxides on the coating surface which is, per se, prone to oxygenation, because such oxide inclusions favor an undesired porosity. It is striven for an entire porosity of less than 3% whereby the pores shall be essentially closed. Moreover, it is suggested to roughen the applied coating to an arithmetic mean roughness $R_a$ of 4 to 30 $\mu$m. However, by the suggested measures, neither the oil consumption can be considerably lowered nor the tribologic characteristics can be considerably improved.

Further, U.S. Pat. No. 5,766,693 discloses a plasma coating method in which mixed layers consisting of metals and metal oxides in their lowest oxidation stage are created and in which the metallic regions are separated from the metal oxide regions. It is striven for a content of metal oxides of at most 30%, a degree of porosity of between 3 and 10%, a pore size of between 1 and 6 $\mu$m and a surface roughness (arithmetic mean roughness) of 3.8 to 14 $\mu$m (150 to 550 $\mu$in). However, by the suggested measures, neither the oil consumption can be considerably lowered nor the tribologic characteristics can be considerably improved.

OBJECTS OF THE INVENTION

It is an object of the present invention to avoid the disadvantages of the prior art as discussed herein above, i.e. to provide an improved surface coating of the working surface of a cylinder of a combustion engine which offers favorable conditions for a low oil consumption and simultaneously shows good tribologic characteristics. It is a further object of the invention to provide a method for applying such a surface coating to the working surface of a cylinder of a combustion engine.

SUMMARY OF THE INVENTION

To meet these and other objects, the present invention provides, according to a first aspect, a surface coating of the working surface of a cylinder of a combustion engine, having the combination of the following characteristics:

The coating is applied by plasma spraying; the surface of the coating comprises a plurality of open pores; the degree of porosity of the surface of the coating amounts to between 0.5 and 10%; the statistic mean pore size amounts to between 1 and 50 $\mu$m, whereby at least nearly exclusively pores with a size of less than 100 $\mu$m are present; the pores are stochastically distributed in the surface of the coating, both as far as the area and the size is concerned; the coating comprises a content of bound oxygen of between 0.5 and 8% by weight; the coating comprises inclusions of FeO and $Fe_3O_4$ crystals, serving as solid lubricants; and the roughness of the surface of the coating is adjusted by mechanically finishing it to an arithmetic mean roughness $R_a$ of between 0.02 and 0.4 $\mu$m and to a mean peak-to-valley distance $R_z$ of between 0.5 and 5 $\mu$m.

According to a second aspect, the invention provides a method of applying a surface coating to the working surface of a cylinder of a combustion engine. Thereby, the surface coating has a plurality of open pores, the degree of porosity of the surface of the coating amounts to between 0.5 and 10%, and the statistic mean pore size amounts to between 1 and 50 $\mu$m, whereby at least nearly exclusively pores with a size of less than 100 $\mu$m are present. Further, the pores are stochastically distributed in the surface of the coating, both as far as the area and the size is concerned, the coating comprising a content of bound oxygen of between 0.5 and 8% by weight, and the coating further comprising inclusions of FeO and $Fe_3O_4$ crystals, serving as solid lubricants. The method comprises the step of plasma spraying a gas or water atomized coating powder having a particle size of between 5 and 100 $\mu$m to the working surface of the cylinder, whereby the spraying distance amounts to between 20 and 50 mm.

The arithmetic mean roughness $R_a$ mentioned in this patent application is sometimes designated simply as "mean roughness value" or as CLA (Center Line Average). It is defined as the height of a rectangle, whose length corresponds to the length of a predetermined measurement path and whose area corresponds to the area between the profile center line and the surface profile. The mean peak-to-valley distance $R_z$ is defined as the mean value of the individual peak-to-valley distances of five consecutive measurement paths (cf. Encyclopedia "Enzyklopädie Naturwissenschaft und Tech-nik", Volume 3, Publisher: "Moderne Industrie", Landsberg a. Lech, Germany 1960, ISBN 3-478-41820-X, Pages 3063 to 3065).

By means of the characteristics according to the invention, on the one hand, it is ensured that enough pores are present for receiving the oil required to form an oil film between piston rings and cylinder wall and, thereby, for keeping the good tribologic properties. On the other hand, due to the very small pores (cavities), the absolute oil consumption can be kept low. In contrast to surface coatings of the working surface of a cylinder according to the prior art, in which the porosity was not or could not be specifically influenced, the surface coating of the invention comprises a porous fundamental structure in which the size of the individual pores is kept within a well defined region. By means of the mechanical finishing, the pores at the surface of the coating are opened.

BRIEF DESCRIPTION OF THE DRAWINGS

In the following, an embodiment of the surface layer according to the invention will be further described, with reference to the accompanying drawings, in which.

DETAILED DESCRIPTION OF A PREFERRED EMBODIMENT

Figure 1:
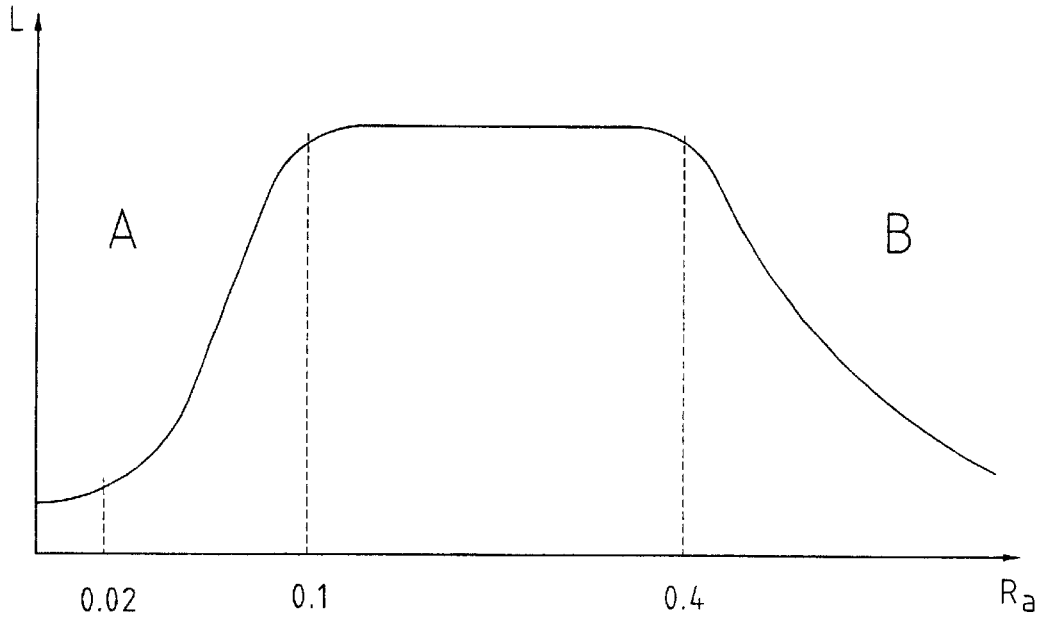
FIG. 1 shows a diagram representing the relation between the mean peak-to-valley height $R_a$ and the performance level of the coating.

The present invention is based on the surprising discovery that an important mutual technical relationship exists between the arithmetic mean roughness $R_a$ and the behavior of the coating. In the abscissa (x-axis) of FIG. 1, the arithmetic mean roughness $R_a$ is indicated, while the ordinate (y-axis) of FIG. 1 shows the performance level L of the coating in a qualitative, not in a quantitative manner. The performance level L is the integral of friction coefficient, oil consumption and wear resistance. If the arithmetic mean roughness $R_a$ of the coating is too low, there is a danger of adhesive wear, the so-called scuffing (region A in FIG. 1); if the arithmetic mean roughness $R_a$ of the coating is too high, the oil consumption is unacceptably increased (region B in FIG. 1). The desired improvement can be realized by the combination of the characteristics defined in claim 1.

Figure 2:
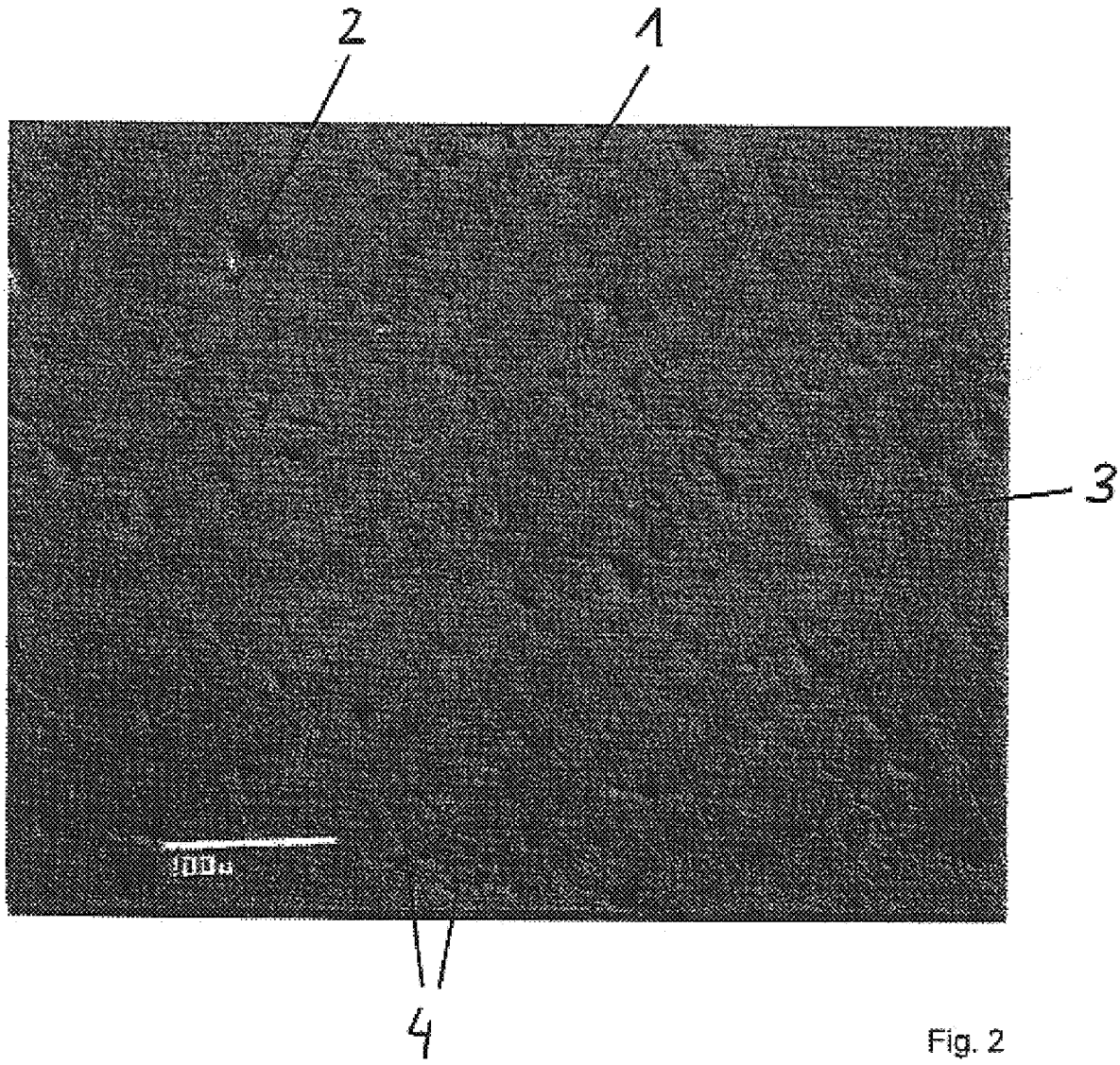
FIG. 2 shows a photographic picture of a cylinder working surface coating.

With the aid of the photographic picture of a surface coating of the working surface of a cylinder as shown in FIG. 2, in the following, an example of the composition of the surface layer as well as a preferred method of applying the surface coating will be further explained.

The surface coating 1 of the working surface of a cylinder shown in FIG. 2 is applied by means of a plasma spraying apparatus and comprises a plurality of pores 2, 3, 4. The pores have a size of between 2 and 30 $\mu$m, whereby the predominant portion of the pores has a size of between appr. 5 and 20 $\mu$m. The degree of porosity of the coating, i.e. the portion of the pores compared to the entire volume of the layer, amounts to between 1 and 5%. Similarly, as far as the area is concerned, the portion of the pores 2, 3, 4 compared to the entire area of the layer 1 amounts to between 1 and 5%. The surface coating 1 of the working surface of a cylinder is set up such that essentially only pores 2, 3, 4 with a size <100 $\mu$m occur.

The surface coating 1 of the working surface of a cylinder comprises a content of bound oxygen of 0.5 to 8% by weight, whereby the bound oxygen, together with iron, forms FeO and $Fe_3O_4$ crystals which act as solid lubricants. Preferably, the content of $Fe_2O_3$ amounts to less than 0.2% by weight. The amount of the oxides thus formed can be further controlled by changing the composition of the air flowing through the cylinder bore to be coated during the coating process, particularly by adding or reducing the amounts of oxygen and/or nitrogen in the air. Moreover, the portion of the oxygen bound in the surface coating 1 of the working surface of a cylinder can be further controlled by decreasing or increasing the flow velocity of he air flowing through the cylinder bore to be coated during the coating process. If the air is replaced by pure oxygen, the portion of bound oxygen in the coating is reduced by a factor of about two.

The surface coating 1 of the working surface of a cylinder, consisting predominantly of iron, has essentially the following chemical composition:

| | |
|---|---|
| C = | 0.05 to 1.5% by weight |
| Mn = | 0.05 to 3.5% by weight |
| Cr = | 0.05 to 18% by weight |
| Si = | 0.01 to 1% by weight |
| S = | 0.001 to 0.4% by weight |
| Fe = | Difference to 100% by weight. |

Preferably, the surface coating 1 of the working surface of a cylinder comprises a micro hardness according to Vickers ($HV_{0,3}$) of 350 to 550 N/mm$^2$.

In order to achieve good machining properties of the surface coating 1 of the working surface of a cylinder by the formation of MnS-compounds, it contains preferably between 1.2 and 3.5% by weight of manganese and between 0.005 and 0.4% by weight sulfur.

The pores 2, 3, 4 are stochastically distributed in the surface coating 1 of the working surface of a cylinder, both with regard to the area and to the size. For applying the surface coating 1 to the working surface of a cylinder, preferably a rotating plasma spraying apparatus is used, with the result that the engine block to be treated can be kept stationary during the coating operation. Once having been applied, the surface coating 1 of the working surface of a cylinder is mechanically finished, particularly by honing, preferably by diamond honing, until the roughness of the surface coating 1 of the working surface of a cylinder is adjusted to an arithmetic mean roughness $R_a$ of 0.02 to 0.4 $\mu$m and a mean peak-to-valley height $R_z$ of 0.5 to 5 $\mu$m, preferably to an arithmetic mean roughness $R_a$ of 0.02 to 0.2 $\mu$m and a mean peak-to-valley height $R_z$ of 1 to 3 $\mu$m.

The degree of porosity of the coating 1, i.e. the portion of the pores 2, 3, 4 compared to the entire volume of the layer, as well as the size (dimension) of the pores 2, 3, 4 can be specifically controlled by changing the coating parameters as well as the particle size of the coating powder. Thereby, particularly the enthalpy of the plasma plays a significant role, which is determined predominantly by the hydrogen content of the plasma gas as well as by the plasma current.

In the process of applying a surface coating 1 to the working surface of a cylinder according to the invention, the surface coating 1 is created by plasma spraying a gas- or water-atomized coating powder having a particle size of between 5 and 100 $\mu$m, preferably of between 10 and 50 $\mu$m, whereby the spraying distance, i.e. the distance between the powder injector of the plasma spraying apparatus and the surface to be coated, amounts to 20 to 50 mm.

As a plasma gas, preferably argon with a content of 0.5 to 5 NLPM (normal liters per minute) of hydrogen is used. The plasma current preferably is between 100 and 500 amperes, more preferably between 260 and 360 amperes, at a voltage of between 35 and 45 volts.

Such a surface coating 1 of the working surface of a cylinder is particularly suitable to be applied to a substrate consisting of cast aluminum alloy, wrought aluminum alloy, lamellar graphite cast iron, vermicular graphite cast iron, spheroidal graphite cast iron, or cast magnesium alloy.

What is claimed is:

1. A surface coating of the working surface of a cylinder of a combustion engine, having the combination of the following characteristics:

the coating is applied by plasma spraying;

the surface of the coating comprises a plurality of open pores;

the degree of porosity of the surface of the coating amounts to between 0.5 and 10%;

the statistic mean pore size amounts to between 1 and 50 μm, whereby at least nearly exclusively pores with a size of less than 100 μm are present;

the pores are stochastically distributed in the surface of the coating, both as far as the area and the size is concerned;

the coating comprises a content of bound oxygen of between 0.5 and 8% by weight;

the coating comprises inclusions of FeO and $Fe_3O_4$ crystals, serving as solid lubricants;

the roughness of the surface of the coating is adjusted by mechanical finishing to an arithmetic mean roughness $R_a$ of between 0.02 and 0.4 μm and to a mean peak-to-valley distance $R_z$ of between 0.5 and 5 μm.

2. A surface coating according to claim 1 in which the statistic mean pore size amounts to between 1 and 10 μm and the degree of porosity amounts to between 0.5 and 5%.

3. A surface coating according to claim 1 in which the roughness of the surface of the coating is adjusted to an arithmetic mean roughness $R_a$ of between 0.05 and 0.2 μm and to a mean peak-to-valley distance $R_z$ of between 1 and 3 μm.

4. A surface coating according to claim 1 in which the roughness of the surface of the coating is adjusted by honing.

5. A surface coating according to claim 1 in which the roughness of the surface of the coating is adjusted by diamond honing.

6. A surface coating according to claim 1 in which the coating has a Vickers micro hardness $HV_{0,3}$ of 350 to 550 $N/mm^2$.

7. A surface coating according to claim 1 in which the coating additionally comprises C, Mn, Cr, Si and S.

8. A surface coating according to claim 7 in which the coating has the following chemical composition:

| | |
|---|---|
| C = | 0.05 to 1.5% by weight |
| Mn = | 0.05 to 3.5% by weight |
| Cr = | 0.05 to 18% by weight |
| Si = | 0.01 to 1% by weight |
| S = | 0.001 to 0.4% by weight |
| Fe = | Difference to 100% by weight. |

9. A surface coating according to claim 7 in which the coating has the following chemical composition:

| | |
|---|---|
| C = | 0.05 to 0.8% by weight |
| Mn = | 0.05 to 1.8% by weight |
| Cr = | 11.5 to 18% by weight |
| Si = | 0.01 to 1% by weight |
| S = | 0.002 to 0.2% by weight |
| Fe = | Difference to 100% by weight. |

10. A surface coating according to claim 1 in which the coating contains, for improved machining properties, between 1.2 and 3.5% by weight Mn and between 0.05 and 0.4% by weight S.

11. A method of applying a surface coating to the working surface of a cylinder of a combustion engine, the surface coating having a plurality of open pores, the degree of porosity of the surface of the coating amounting to between 0.5 and 10%, the statistic mean pore size amounting to between 1 and 50 μm, whereby at least nearly exclusively pores with a size of less than 100 μm are present, the pores being stochastically distributed in the surface of the coating, both as far as the area and the size is concerned, the coating comprising a content of bound oxygen of between 0.5 and 8% by weight, and the coating further comprising inclusions of FeO and $Fe_3O_4$ crystals, serving as solid lubricants, the method comprising the step of plasma spraying a gas or water atomized coating powder having a particle size of between 5 and 100 μm to the working surface of the cylinder, whereby the spraying distance amounts to between 20 and 50 mm.

12. A method according to claim 11 in which the particle size of the coating powder amounts to between 10 and 50 μm.

13. A method according to claim 11 in which the coating powder has the following chemical composition:

| | |
|---|---|
| C = | 0.05 to 1.5% by weight |
| Mn = | 0.05 to 3.5% by weight |
| Cr = | 0.05 to 18% by weight |
| Si = | 0.01 to 1% by weight |
| S = | 0.001 to 0.4% by weight |
| Fe = | Difference to 100% by weight. |

14. A method according to claim 11 in which the coating has the following chemical composition:

| | |
|---|---|
| C = | 0.05 to 0.8% by weight |
| Mn = | 0.05 to 1.8% by weight |
| Cr = | 11.5 to 18% by weight |
| Si = | 0.01 to 1% by weight |
| S = | 0.002 to 0.2% by weight |
| Fe = | Difference to 100% by weight. |

15. A method according to claim 11 in which the surface coating is mechanically finished by diamond honing.

16. A method according to claim 11 in which the size of the coating powder particles and/or the chemical composition of the coating powder material and/or the enthalpy of the plasma is varied for creating the desired characteristics of the coating and for adjusting the size of the pores and/or of the degree of porosity.

17. A method according to claim 16 in which the enthalpy of the plasma is varied by changing the plasma current and/or by varying the portion of hydrogen in the plasma gas.

18. A method according to claim 17 in which the enthalpy of the plasma is varied by changing the plasma current, whereby the plasma current is adjusted to a value between 100 and 500 amperes.

19. A method according to claim 17 in which the plasma current is adjusted to a value between 260 and 320 amperes.

20. A method according to claim 11 in which a plasma gas having a portion of between 0.5 and 5 NLPM (normal liter per minute) of hydrogen is fed to the plasma spraying apparatus.

21. A method according to claim 20 in which argon is used as a plasma gas.

* * * * *